United States Patent [19]

Crooks

[11] 4,348,837

[45] Sep. 14, 1982

[54] METHOD AND APPARATUS FOR BEVELING THE FRONT END OF A FELT PAD

[75] Inventor: David R. Crooks, Medina, Ohio

[73] Assignee: Hapad, Inc., Bethel Park, Pa.

[21] Appl. No.: 166,137

[22] Filed: Jul. 7, 1980

[51] Int. Cl.[3] ..... B24B 9/00; B24B 9/02; C14B 1/14

[52] U.S. Cl. ..... 51/5 R; 51/324; 69/37

[58] Field of Search ..... 51/5 R, 5 B, 72 R, 74 R, 51/92 R, 38, 91 R, 324, DIG. 17, 323, 327, 3, 122, 126, 181, 218 R, 400, 281 SF, 283 E; 69/9, 24, 16, 37; 12/142 G, 46.5; 26/28, DIG. 1

[56] References Cited

U.S. PATENT DOCUMENTS

| | | | |
|---|---|---|---|
| 609,868 | 8/1898 | Bayley | 69/16 |
| 799,641 | 9/1905 | Fox | 51/72 R |
| 1,578,653 | 3/1926 | Gallagher | 69/16 |
| 1,642,719 | 9/1927 | Brogan | 69/16 |
| 2,365,396 | 12/1944 | Cunningham | 51/DIG. 17 |
| 2,814,913 | 12/1957 | DeWitt | 51/5 R |
| 2,958,163 | 11/1960 | Cammerzell, Jr. | 51/5 R |
| 3,066,331 | 12/1962 | Skelton | 51/5 B |

*Primary Examiner*—Stephen G. Kunin
*Assistant Examiner*—Robert A. Rose
*Attorney, Agent, or Firm*—Martin J. Carroll

[57] ABSTRACT

A felt pad having a beveled front end is produced from a workpiece having a flat bottom with an adhesive thereon covered with a strip of paper or the like and a straight front end. The apparatus includes a rotatable shaft having mounted thereon an abrasive wheel and a wire brush wheel including a cylindrical portion of the same diameter as the abrasive wheel abutting the abrasive wheel and a tapered portion extending toward the shaft axis. A shear plate provides a cutting surface with the abrasive wheel. The workpiece is mounted on a table and fed parallel to the shaft axis with its forward end also parallel thereto. The rotating brush bevels the front end of the pad and fuzz still attached to the pad is removed as it passes between the abrasive wheel and shear plate. A shroud surrounds the wheels and a suction is applied thereto to draw off the materials removed from the workpiece.

9 Claims, 4 Drawing Figures

40
41
42
28
P
38
36
28
39
20
14
32
24
18
16
32
4
48
10
50
8
30
12
4
48
6
B
16
38
18
32
24
20
14
32
P
36
II
39
40
41
42
28
28
26
26
II

P
C
B

METHOD AND APPARATUS FOR BEVELING THE FRONT END OF A FELT PAD

This invention relates to a method of and apparatus for beveling the front end of a workpiece and more particularly to beveling the front end of a felt pad for the heel of a shoe. Such pads are generally made from wool and have a flat bottom with glue thereon which is covered with a strip of paper. Prior to my invention a grinding wheel was sometimes used for this purpose, but it was not satisfactory. Adhesive built upon the wheel which had to be frequently cleaned. Even so the machined surface was not always true and it was necessary to replace the wheel frequently. Also there was danger to the workmen due to operation of the machine as well as from the material removed. A shear-type cutter was also used, but this too was unsatisfactory. Again there was build up on the cutter, requiring frequent cleaning and replacement and danger to the workmen. A rotating cutting blade was also tried, but it also had the above drawbacks. A cylindrical wire brush was tried, but it was difficult and dangerous to operate.

I have found that the bevel can be produced efficiently and safely by means of a rotating tool by providing a special wheel so shaped that the workpiece is fed to the wheel from the side rather than from the front in the usual manner. In addition, I provide suction to remove the material cut from the workpiece. This produces a healthy atmosphere and in combination with the special wheel limits build up of material. Thus the cost of the operation is greatly reduced.

It is therefore an object of my invention to provide apparatus for beveling the front end of a workpiece which is more efficient and safer than previous apparatus.

Another object is to provide such apparatus which is less expensive to produce and maintain.

Still another object is to provide a method of beveling the front end of a felt heel pad for a shoe in a safer and less expensive manner than by previous methods.

These and other objects will be more apparent after referring to the following specification and attached drawings in which.

Figure 1:
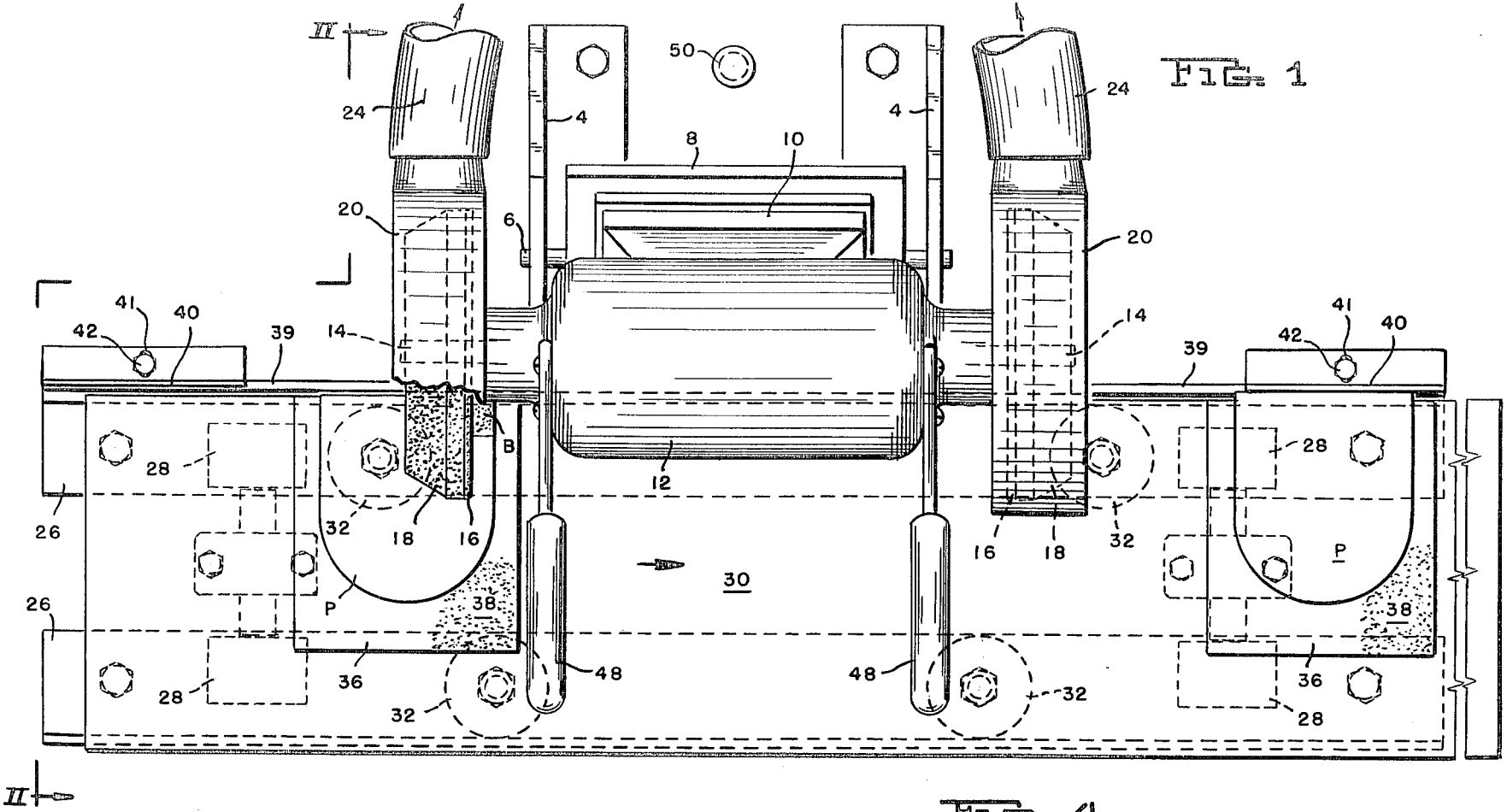
FIG. 1 is a plan view of the apparatus of my invention.
Figure 4:
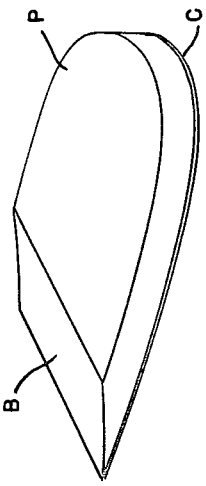
FIG. 4 is a perspective view of a finished pad.
Figure 2:
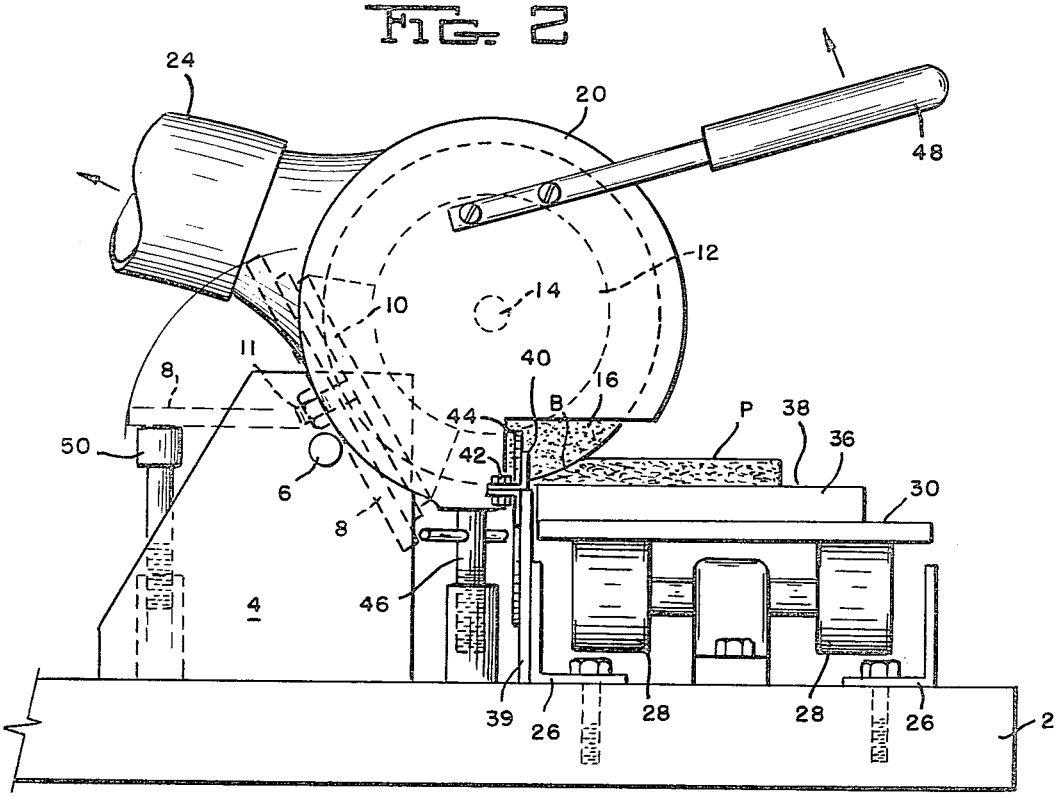
FIG. 2 is a view taken on the line II—II of FIG. 1.
Figure 3:
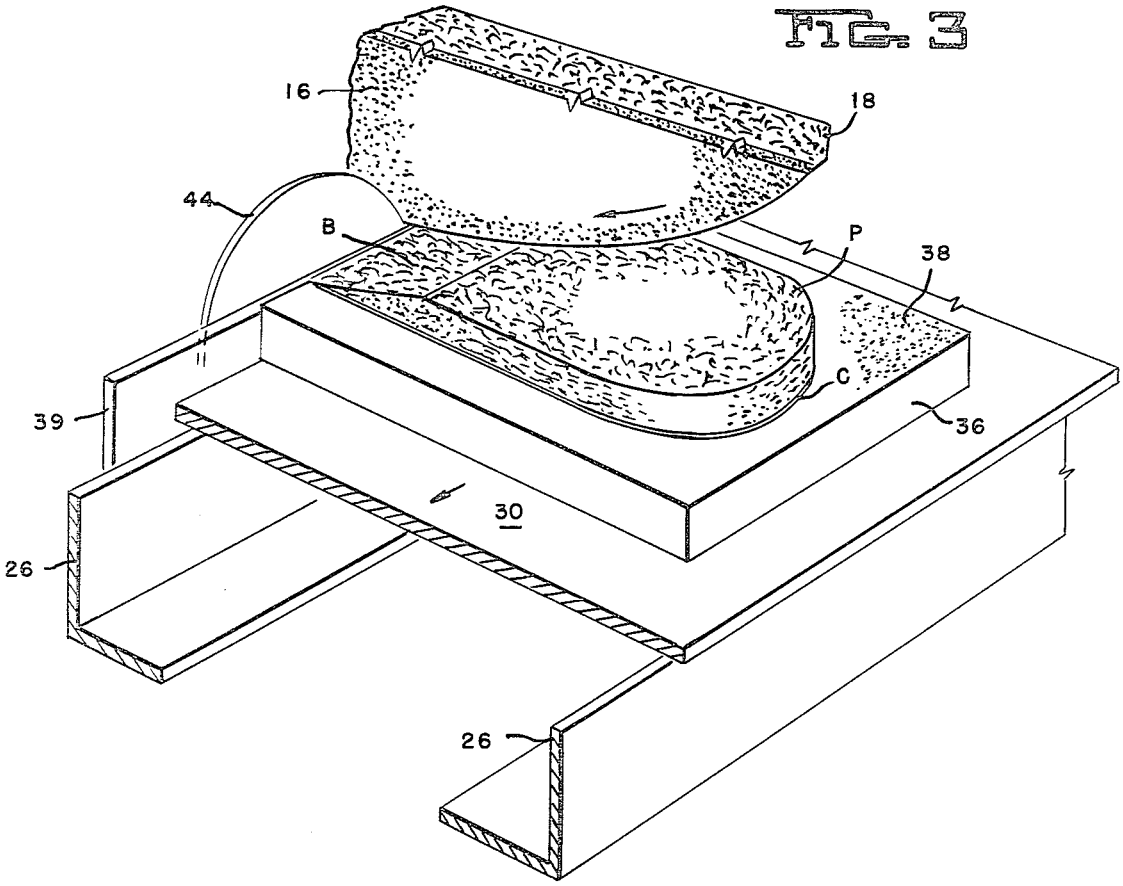
FIG. 3 is a perspective view showing a pad being machined.

Referring more particularly to the drawings reference numeral 2 indicates the housing of my machine. Mounted on the housing 2 are spaced apart brackets 4 for rotatably mounting a shaft 6 extending therebetween. A plate 8 is welded or otherwise secured to the shaft 6. A bottom plate 10 is pivotally mounted on plate 8 about pivot 11 and supports a motor 12 of a conventional grinder having a shaft 14 extending from each end. Mounted on each end of the shaft 14 is a circular fiber reinforced abrasive blade 16 adjacent the motor 12. A circular wire wheel brush 18 is mounted on shaft 14 in abutting relationship with each blade 16. The brush 18 is cylindrical adjacent the blade 16 and has the same diameter as the blade. The brush tapers at a substantial angle to a smaller diameter at its outer end. In one particular embodiment the brush is 7" in diameter with a 1" face and the taper or bevel is 45°. This was made from a brush manufactured by The Manufacturers Brush Company, 12501 Elmwood Ave., Cleveland, Ohio 44111 and identified as Advance 7"×1" Wire, Wheel, Brush [00618/104 Wire 0.011]. While I made the bevel 45° this angle is not critical and may vary especially for different pad thicknesses. A substantially air tight shroud 20 surrounds each blade and brush combination and is connected to a suction (not shown) by means of a flexible suction conduit 24.

Mounted on housing 2 in close proximity to the motor 12 are a pair of guide bars 26 parallel to the axis of shaft 14. Mounted between the bars 26 adjacent each end thereof are a pair of wheels 28 such as used with skate boards. It will be understood that a single wheel may be used in place of the two wheels or other supporting surfaces may be used for slidably supporting a table 30 movable parallel to the axis of shaft 14 between bars 26. Guide wheels 32 supported on table 30 with their axes vertical are provided for contacting guide bars 26. A pair of pedistals 36 with sandpaper 38 or other gripping surface on top of each pedistal are secured to the top of table 30 in spaced apart relationship.

A pair of members 39 are secured to the inner guide bar 26 one adjacent each blade and brush combination. A backstop 40 for the workpiece P is adjustably secured to each member 39. This may be done by means of an elongated slot 41 in the backstop 40 with a bolt 42 passing through this slot and screwed into a threaded hole in the member 39. A shear plate 44 is also secured to each plate 40. The plate 44 is circular and may be rotatably adjusted about its horizontal axis. The shear plate instead of being circular as shown may be longitudinally movable toward and away from the blade 16. In either case the shear plate has a cutting surface for substantially contacting the face of the blade. At least one of the blade 16 and shear plate 44 must have an abrasive surface while the other may be metal, such as steel, or abrasive. Mounted on housing 2 adjacent each blade and brush combination is a jack screw 46 for supporting the grinding wheel assembly at the desired height. Handles 48 attached to motor 12 are gripped to move the grinder assembly between a position on jack screws 46 and a position on vertical stops 50 secured on housing 2.

My invention is particularly suitable for providing a bevel B on the straight edge of a felt foot heel pad P having a layer of glue on its bottom covered with paper C. These pads come in various widths and thicknesses and in operation the machine must first be adjusted for the pad size to be beveled. The pad backstops 40 are moved horizontally toward or away from the motor 12 merely by loosening bolts 42 and then tightening it after adjustment in order the depth and longitudinal angle of cut. The metal disc or shear plate 44 is rotated to a position where its surface will be in direct contact with blade 16. The screw jacks 46 are positioned at the correct elevation to obtain the desired cut. Lowering the screw jacks 46 will result in a larger brush cut into the felt and the blade 16 will grind into backplate 44 creating a new cutting surface. Raising the screw jacks 46 results in a smaller brush cut into the felt and also requires adjustment of the backplate 44 to obtain a new cutting surface. By swiveling plate 10 about pivot axis 11 individual adjustment of the two blade and brush combinations can be made if such becomes necessary.

With the machine properly adjusted the cutting assembly is raised from stops 50 and positioned on screw jacks 46, the motor 12 is energized, and suction is provided to the shrouds 20. With the slide 30 in its left hand position a pad P is positioned thereon with its paper covering C resting on surface 38 and its straight edge abutting backstop 42. With the operator holding the pad firmly in position he moves the slide 30 to the right. The operation proceeds smoothly because of the 45° bevel on the wire brush with the wire brush forming the bevel on the pad P. Some or all of the trailing edge fuzz created by the wire brush will be removed by the blade 16 contacting the backplate 44. The operator places another pad on the right hand surface 38 and moves the table back to its original position to make the bevel on this second pad. The operation is then repeated. I have found that the operation is performed smoothly, safely and with little build up of removed materials to hinder the operation.

While one embodiment has been shown and described it will be apparent that other modifications may be made within the scope of the following claims.

I claim:

1. Apparatus for beveling the front end of a felt workpiece having a substantially straight front edge which includes a housing, a motor mounted on said housing, a shaft rotated by said motor, a wire wheel brush mounted on said shaft for rotation therewith, a shroud surrounding said brush, means for applying a suction to said shroud, said brush having a cylindrical portion on the side adjacent said motor and a tapered portion on the side opposite said motor extending away from said cylindrical portion toward said shaft, a blade mounted on said shaft adjacent the cylindrical portion of said brush for rotation therewith, a shearplate mounted on said housing adjacent said blade and having a cutting surface for substantially contacting the face of said blade, at least one of said blade and shear plate having an abrasive surface, a table mounted on said housing for supporting the bottom of said workpiece with its front end facing said wire wheel and substantially parallel to the axis thereof, and a table support, said table being movable on said table support substantially parallel to the axis of said brush from a loading position with the workpiece on the side of said brush remote from said motor to a position on the opposite side of said brush whereby the front end of said workpiece is beveled.

2. Apparatus according to claim 1 including a back stop mounted on said housing adjacent said table and said brush for locating the forward end of said workpiece.

3. Apparatus according to claim 1 including means for supporting said motor, brush and blade for pivotal movement toward and away from said table, and an adjustable support for limiting movement of said motor, brush and blade toward said table.

4. Apparatus according to claim 2 in which said table support includes spaced apart wheels on axes transverse to the path of movement of said table, and a pair of side guides extending parallel to the path of movement of said table and receiving said table therebetween.

5. Apparatus for beveling the front end of felt workpieces having a substantially straight front edge which includes a housing, a motor mounted on said housing, a shaft rotated by and extending from each end of said motor, a wire wheel brush mounted on each end of said shaft for rotation therewith, each brush having a cylindrical portion on the side adjacent said motor and a tapered portion extending away from said cylindrical portion toward said shaft, a blade mounted on said shaft adjacent the cylindrical portion of each of said brushes for rotation therewith, a shear plate mounted on said housing adjacent each of said blades and having a cutting surface for substantially contacting the face of the adjacent blade, at least one of each of said blades and adjacent shear plate having an abrasive surface, a table mounted on said housing for supporting the bottom of said workpieces with their front end facing said wire wheel and substantially parallel to the axis thereof, and a table support, said table being movable on said table support substantially parallel to the axis of said brushes between a position with an unworked workpiece on the outboard side of one of said brushes to a position with the beveled workpiece on the inboard side thereof.

6. Apparatus according to claim 5 including a back stop mounted on said housing adjacent each end of said table on the outboard side of each brush for locating the forward end of the workpieces.

7. Apparatus according to claim 6 including means for supporting said motor, brushes and blades for pivotal movement toward and away from said table, and a pair of longitudinally spaced supports for limiting movement of said motor, brushes and blades toward said table.

8. Apparatus according to claim 7 in which said table support includes spaced apart wheels on axes transverse to the path of movement of said table, and a pair of side guides extending parallel to the path of movement of said table and receiving said table therebetween.

9. A method of beveling the front end of a felt workpiece having an adhesive on its flat bottom surface covered with a strip of material, said workpiece having a substantially straight front edge, which method includes positioning said workpiece with its bottom surface resting on a table top and its front end bearing against a back plate to one side of a rotatable wire brush having a tapered portion extending toward its axis and the backplate and a cylindrical portion connected to the large diameter end of said tapered portion, moving said workpiece parallel to the axis of said rotating brush into contact first with the tapered portion of said brush and then completely over the cylindrical portion of said wire brush to provide a bevel on the front end of said workpiece, continuing movement of said workpiece between a shear plate and a rotating wheel coaxially positioned against the cylindrical portion of said brush and having the same diameter as said cylindrical portion of said brush so as to remove fuzz produced by the wire brush but still attached to the workpiece, surrounding said brush and wheel with a shroud, and supplying a suction to said shroud to discharge material removed from said workpiece.

* * * * *